US005816335A

United States Patent [19]

Yamamoto et al.

[11] Patent Number: 5,816,335

[45] Date of Patent: Oct. 6, 1998

[54] DOZING SYSTEM FOR USE IN BULLDOZER

[75] Inventors: Shigeru Yamamoto; Hidekazu Nagase, both of Osaka, Japan

[73] Assignee: Komatsu Ltd., Tokyo, Japan

[21] Appl. No.: 972,059

[22] Filed: Nov. 17, 1997

[30] Foreign Application Priority Data

Nov. 18, 1996 [JP] Japan ..... 8-306232

[51] Int. Cl.[6] ..... A01B 67/00

[52] U.S. Cl. ..... 172/4.5; 172/3; 172/7; 364/424.07

[58] Field of Search ..... 37/348, 907; 172/2, 172/3, 4, 4.5, 7, 9, 821; 364/424.07; 414/699

[56] References Cited

U.S. PATENT DOCUMENTS

| | | |
|---|---|---|
| 4,282,933 | 8/1981 | Suganami et al. . |
| 4,630,685 | 12/1986 | Huck, Jr. et al. . |
| 5,462,125 | 10/1995 | Stratton et al. . |
| 5,467,829 | 11/1995 | Barton et al. . |

FOREIGN PATENT DOCUMENTS

| | | |
|---|---|---|
| 55-36776 | 9/1980 | Japan . |
| 57-34765 | 7/1982 | Japan . |
| 62-291337 | 12/1987 | Japan . |
| 63-6694 | 2/1988 | Japan . |
| 1-163324 | 6/1989 | Japan . |
| 3-43523 | 2/1991 | Japan . |
| 4-285214 | 10/1992 | Japan . |
| 5-106239 | 4/1993 | Japan . |
| 6-3886 | 2/1994 | Japan . |
| 7-11665 | 1/1995 | Japan . |
| 7-11666 | 1/1995 | Japan . |
| 7-26586 | 1/1995 | Japan . |
| 7-48855 | 2/1995 | Japan . |
| 7-48856 | 2/1995 | Japan . |
| 7-48857 | 2/1995 | Japan . |
| 7-54374 | 2/1995 | Japan . |
| 7-62683 | 3/1995 | Japan . |
| 7-252859 | 10/1995 | Japan . |
| 8-68070 | 3/1996 | Japan . |
| 8-199620 | 8/1996 | Japan . |
| 8-260506 | 10/1996 | Japan . |

*Primary Examiner*—Michael J. Carone
*Assistant Examiner*—Robert Pezzuto
*Attorney, Agent, or Firm*—Armstrong, Westerman, Hattori, McLeland & Naughton

[57] ABSTRACT

A dozing system for use in a bulldozer, having the capability of estimating a loading ratio (the ratio of soil loaded on the blade to the loading capacity of the blade) with high accuracy so that a mode shift from digging to carrying can be stably performed. Data pieces each representing the digging distance of the bulldozer and the associated loading ratio are obtained from n previous dozing operations and stored. The average of the stored data pieces obtained from n operations is calculated and according to the average, data representative of a digging distance and its associated loading ratio obtained from the present dozing operation is compensated.

6 Claims, 16 Drawing Sheets

DOZING SYSTEM FOR USE IN BULLDOZER

TECHNICAL FIELD

The present invention relates to a dozing system for use in a bulldozer and more particularly to a technique for calculating the ratio of the amount of soil loaded on the front face of the blade to its loading capacity during the dozing operation of the bulldozer.

BACKGROUND ART

In dozing operation by a known bulldozer, the operator manually manipulates the blade by raising, lowering, tilting and pitching in order to regulate the load on the blade caused by digging and carrying, while avoiding the running slip (shoe slip) of the vehicle body. During the operation, a shift, for example, from digging to carrying is based on the volume of excavated soil loaded on the front face of the blade (i.e., earthwork) that has been estimated by the operator's perception from the shoe slip condition of the vehicle body or from how much excavated soil is being spilt from the blade surface.

However, it is difficult for the operator to accurately estimate the blade's earthwork by his perception, particularly when the bulldozer has a large-sized blade and causes little shoe slip, so that a smooth shift from digging to carrying cannot be carried out with effective timing.

The inventors have made an attempt to solve this problem and proposed a dozing system for bulldozers in Japanese Patent Application No. 8-46600 (1996), which is capable of automatically determining the ratio of the amount of excavated soil loaded on the front face of the blade to the loading capacity of the front face of the blade (this ratio is hereinafter referred to as "loading ratio") during dozing operation. According to the dozing system disclosed in this application, when the loading ratio has reached a specified value and a completion of digging operation has been detected, the blade is pitched back holding the excavated soil thereon and a shift from digging operation to carrying operation is automatically carried out, so that the operator does not need to estimate the volume of soil depending on his perception, which leads to man power saving.

This dozing system however presents the disadvantage that if the determination of the loading ratio based on the horizontal and vertical reaction forces exerted on the blade during dozing operation cannot be accurately performed due to various reasons, the dozing system fails in shifting from digging to carrying with good timing, resulting in a decrease in operational efficiency and loss of energy.

The present invention is directed to overcoming the above problem and one of the objects of the invention is therefore to provide a dozing system for bulldozers which is capable of accurately calculating the loading ratio so that a shift from digging to carrying can be smoothly, stably performed.

DISCLOSURE OF THE INVENTION

The above object can be accomplished by a dozing system for use in a bulldozer according to the invention, the dozing system comprising:

(a) loading ratio calculating means for calculating the loading ratio of the front face of a blade corresponding to the digging distance of the bulldozer during dozing operation, the loading ratio being the ratio of the amount of loaded soil to the loading capacity of the blade, (b) average calculating means for storing digging distance-loading ratio data pieces obtained from a specified number of previous dozing operations, each data piece representing digging distances and their associated loading ratios calculated by the loading ratio calculating means, and for calculating the average of the stored data pieces obtained from the specified number of previous dozing operations; and (c) correcting means for correcting a loading ratio obtained in the present dozing operation, based on the average of the previous data pieces calculated by the average calculating means.

According to the invention, the loading ratio calculating means calculates a loading ratio for a distance that the bulldozer has dug (i.e., digging distance) in every dozing operation. The loading ratio used herein is defined as the ratio of the amount of excavated soil loaded on the front face of the blade to the loading capacity of the blade at its front face. The average calculating means calculates the average of digging distance-loading ratio data pieces obtained from a specified number of dozing operations, each data piece representing digging distances and their associated loading ratios calculated by the loading ratio calculating means. According to this average, a loading ratio obtained in the present dozing operation is corrected by the correcting means. With this arrangement, in the event an error occurs in the determination of a loading ratio due to poor detection accuracy in dozing operation, the erroneous loading ratio would be corrected by data obtained from a specified number of previous dozing operations, so that accurate loading ratio determination can be ensured, resulting in improved efficiency and man power saving in dozing operation.

The dozing system of the invention may further comprise blade controller means for changing the attitude of the blade from a digging attitude to a carrying attitude by pitching the blade back when the loading ratio corrected by the correcting means is equal to a predetermined value. The use of such blade controller means allows the blade to be controlled based on more accurately calculated loading ratios, and as a result, a stable shift from a digging mode to a carrying mode can be achieved.

The average calculating means may calculate the average by simply averaging the digging distance-loading ratio data pieces obtained from the specified number of previous dozing operations or may calculate the average by weighting the latest data pieces taken out of the previous digging distance-loading ratio data pieces and obtaining the moving average of the weighted data pieces. More accurate calculation of the average can be achieved by the latter method, that is, by obtaining the moving average of weighted, latest data.

The correcting means may correct a loading ratio obtained in the present dozing operation by the weighted mean of the data obtained from the present dozing operation and the average of the data obtained from the specified number of previous dozing operations. In this case, a specified allowable range is set for the average of the data pieces obtained from the specified number of previous dozing operations and when a loading ratio calculated in the present dozing operation does not fall in the specified allowable range, this loading ratio is determined to be abnormal and discarded as unacceptable data. With this arrangement, in the event that many errors occur in the data due to disturbance or the like, the errors can be eliminated thereby to obtain a more accurate loading ratio.

BEST MODE FOR CARRYING OUT THE INVENTION

Referring now to the accompanying drawings, a preferred embodiment of the dozing system for use in a bulldozer of the invention will be described.

Figure 1:
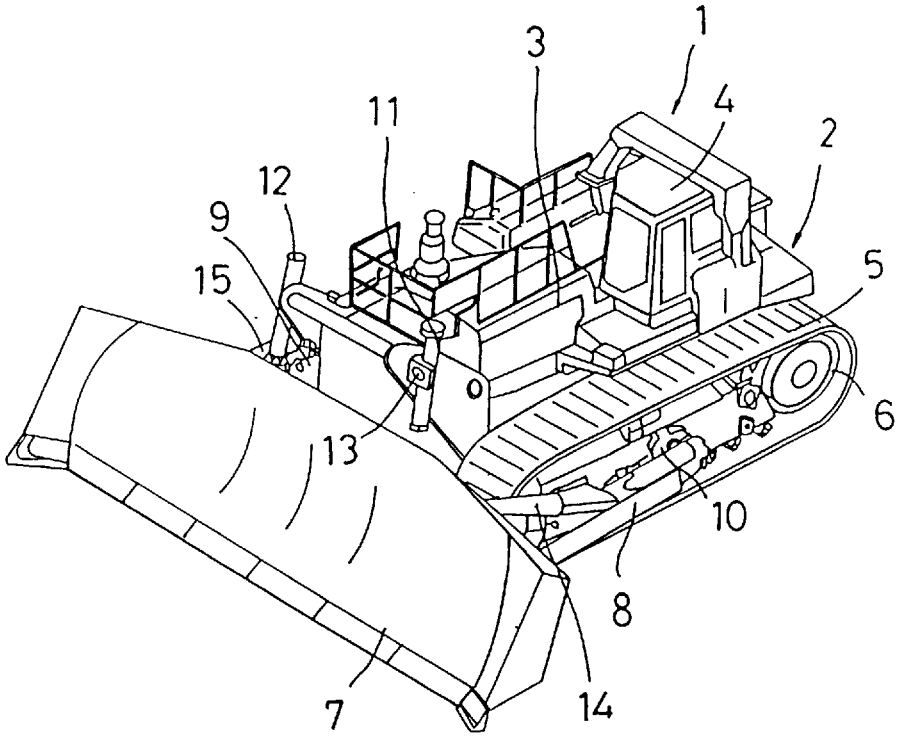
FIG. 1 is a perspective view of the external appearance of a bulldozer according to an embodiment of the invention.
Figure 2:
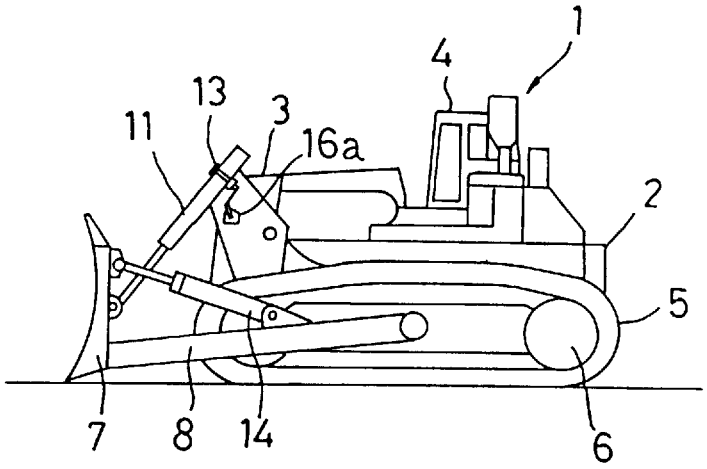
FIG. 2 is a side view of the bulldozer according to the embodiment.

FIG. 1 shows a perspective view of the external appearance of a bulldozer 1 according to this embodiment, while FIG. 2 shows the side view of the bulldozer 1.

The bulldozer 1 has a vehicle body 2 on which a bonnet 3 for housing an engine 20 (described later) and a cab 4 for the operator who drives the bulldozer 1 are provided. Disposed on both right and left sides of the vehicle body 2 when viewed in the forward moving direction of the vehicle body 2 are crawler belts 5 (the crawler belt on the right side is not shown in the drawing) for driving the vehicle body 2 so as to travel forwardly and reversely and turn. The crawler belts 5 are respectively independently driven by power transmitted from the engine 20 with the aid of corresponding sprockets 6.

There is provided a blade 7 in front of the vehicle body 2. The blade 7 is supported at the forward ends of right and left straight frames 8, 9 the base ends of which are, in turn, pivotally supported at the sides of the vehicle body 2 through trunnions 10 (the trunnion on the right side is not shown in the drawing) such that the blade 7 can be lifted or lowered in relation to the vehicle body 2. A pair of blade lift cylinders 11, 12 are disposed in front of both sides of the vehicle body 2, for lifting or lowering the blade 7. The base ends of the blade lift cylinders 11, 12 are respectively supported by yokes 13 that are rotatably mounted on the vehicle body 2, while the other ends of the cylinders 11, 12 are pivotally supported on the back face of the blade 7. For controlling the blade 7 so as to take a digging attitude, pitch forward attitude or pitch back attitude (these attitudes are to be described later), blade pitch cylinders 14, 15 are provided between the blade 7 and the right and left straight frames 8, 9.

The vehicle body 2 is provided with yoke angle sensors 16*a*, 16*b* (the right yoke angle sensor is not shown in the drawing) for detecting the pivoting angle of each yoke 13, that is, the pivoting angle of each of the blade lift cylinders 11, 12. The blade lift cylinders 11, 12 are respectively provided with stroke sensors 19*a*, 19*b* (shown in FIG. 3 only) for detecting the strokes of the blade lift cylinders 11, 12. As seen from the hydraulic circuit diagram of FIG. 3, hydraulic pressure sensors 17H, 17B for respectively detecting hydraulic pressures on the respective heads and bottoms of the blade lift cylinders 11, 12 are disposed in a hydraulic pipe line for providing hydraulic pressure to the heads and bottoms of the blade lift cylinders 11, 12. The outputs of the yoke angle sensors 16*a*, 16*b*, stroke sensors 19*a*, 19*b*, and hydraulic pressure sensors 17H, 17B are entered in a controller 18 consisting of a microcomputer which in turn uses the output data in calculation of a vertical reaction force exerted on the blade 7 (this calculation is to be described later).

Figure 4:
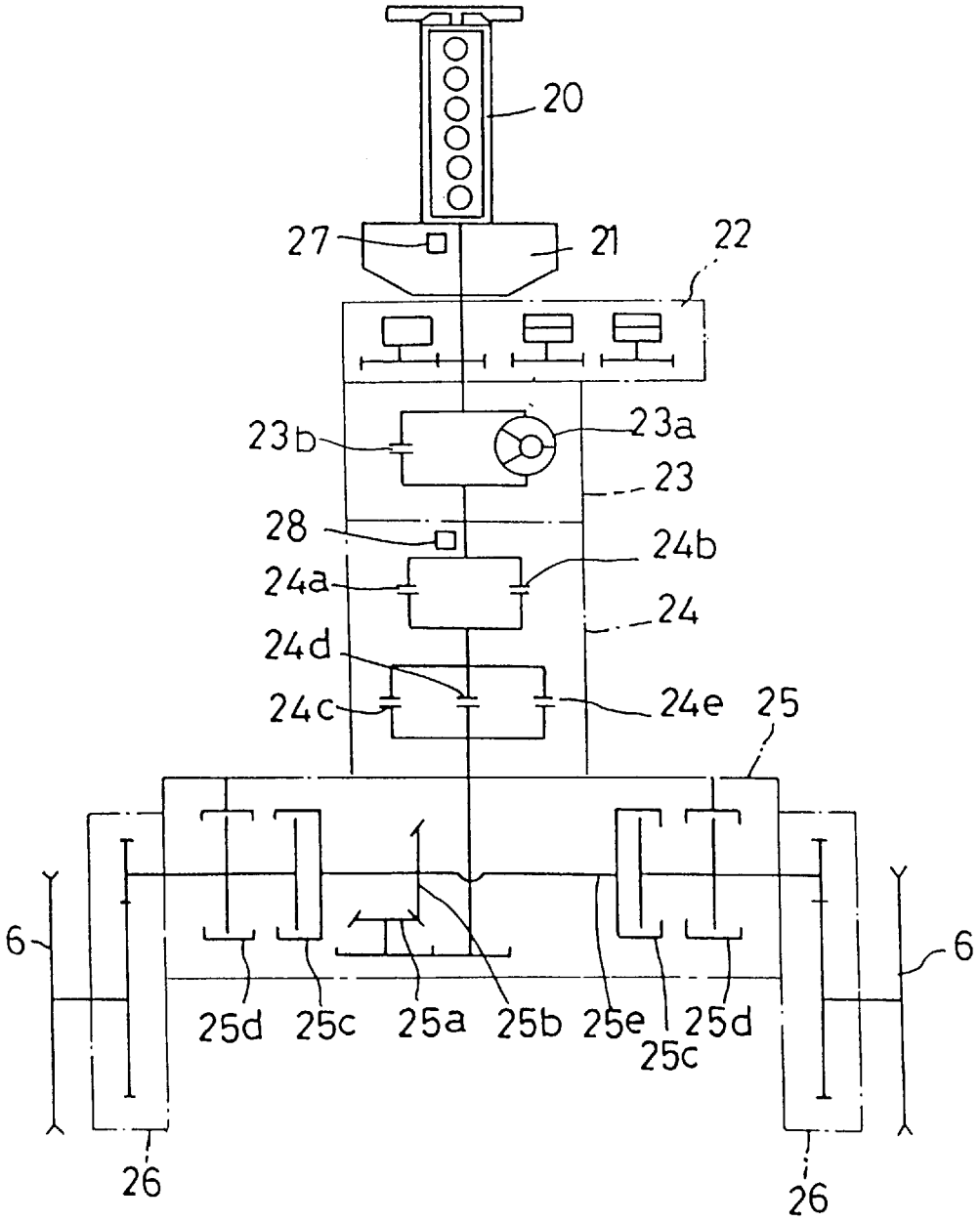
FIG.4 is a skeleton diagram of a power transmission system.

In FIG. 4 showing a power transmission system, the rotary driving power of an engine 20 is transmitted to a damper 21 and a PTO 22 for driving various hydraulic pumps including an implement operating hydraulic pump and then to a torque convertor unit 23 having a torque convertor 23*a* and a lock-up clutch 23*b*. The rotary driving power is then transmitted from the output shaft of the torque convertor unit 23 to a transmission 24 (e.g., wet multiple disc clutch type planetary gear transmission) whose input shaft is coupled to the output shaft of the torque convertor unit 23. The transmission 24 comprises a forward drive clutch 24*a*, reverse drive clutch 24*b* and first to third speed clutches 24*c*, 24*d* and 24*e*, so that the output shaft of the transmission 24 is rotated in three speed ranges in both forward drive and reverse drive. The rotary driving power from the output shaft of the transmission 24 is transmitted to paired right and left final reduction gear mechanisms 26 through a steering system 25 to power the respective sprockets 6 for running the crawler belts 5 (not shown in FIG. 4). The steering system 25 has a transverse shaft 25*e* having a pinion 25*a*, a bevel gear 25*b*, paired right and left steering clutches 25*c* and paired right and left steering brakes 25*d*. Reference numeral 27 designates an engine speed sensor for detecting the engine speed of the engine 20 whereas reference numeral 28 designates a torque convertor output shaft revolution sensor for detecting the revolution speed of the output shaft of the torque convertor 23.

Engine speed data that is representative of the engine speed of the engine 20 and sent from the engine speed sensor 27; revolution data that is representative of the revolution speed of the output shaft of the torque convertor unit 23 and sent from the torque convertor output shaft revolution sensor 28; and a locked-up(L/U) / torque converting(T/C) selection instruction that is representative of whether or not the torque converter 23 is to be locked up and sent from the lock-up shift switch (not shown); are all input in the controller 18 (see FIG. 3) to be used in calculation of a horizontal reaction force (actual tractive force) exerted on the blade 7 (this calculation is to be described later).

Figure 3:
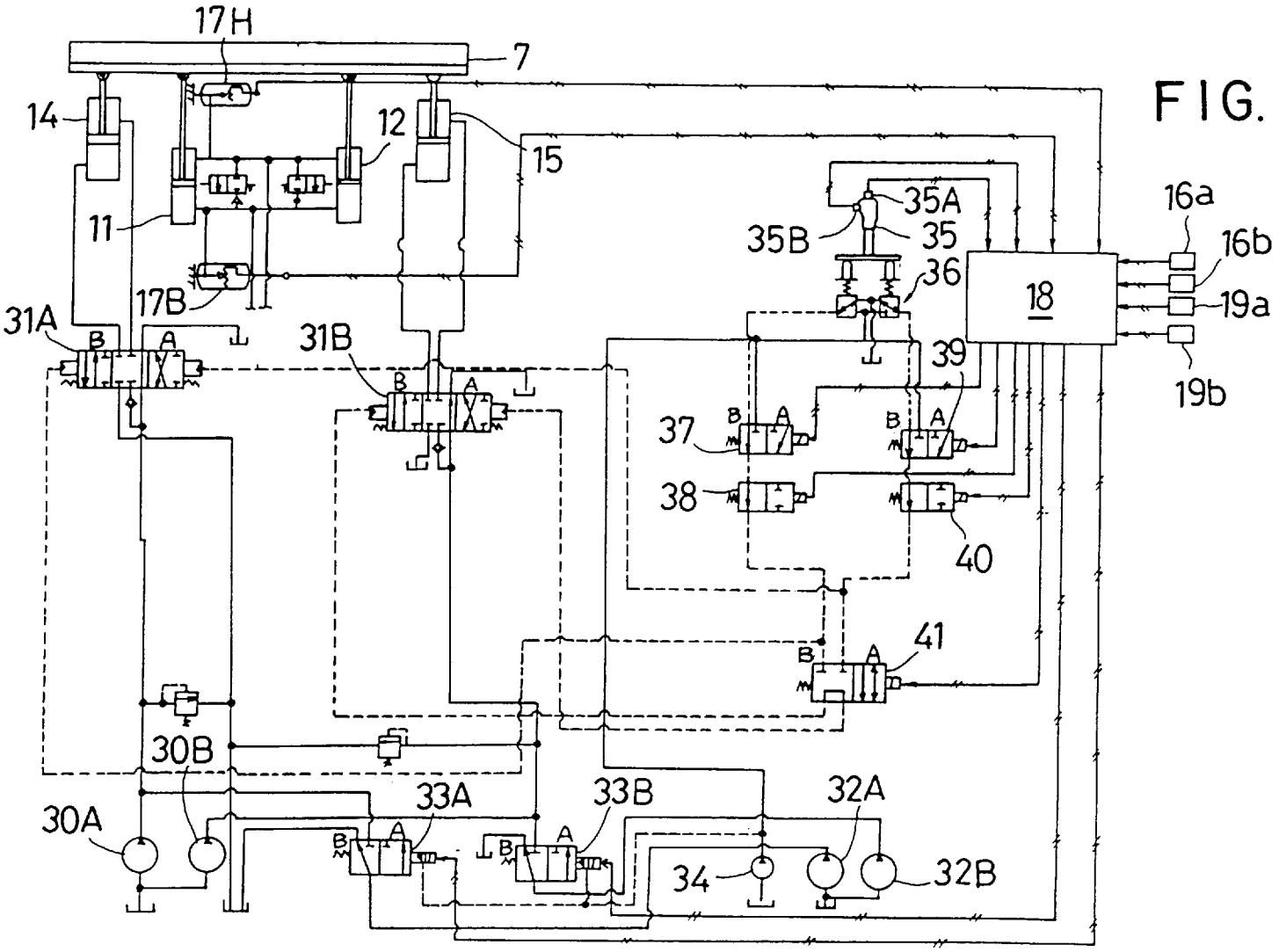
FIG. 3 is a hydraulic circuit diagram showing a pitch operation circuit for a blade.

Reference is made to FIG. 3 for explaining a pitch operation circuit for operating the blade 7 with the blade pitch cylinders 14, 15 according to the embodiment. It should be noted that a lift operation circuit for operating the blade 7 with the blade lift cylinders 11, 12 is omitted from this hydraulic circuit.

In the hydraulic circuit diagram, a first direction control valve 31A is connected to the discharge pipe line of a fixed capacity type hydraulic pump 30A for supplying hydraulic pressure to the left blade pitch cylinder 14 while a second direction control valve 31B is connected to the discharge pipe line of a fixed capacity type hydraulic pump 30B for supplying hydraulic pressure to the right blade pitch cylinder 15. The discharge pipe line of an assist hydraulic pump 32A is connected to the discharge pipe line of the hydraulic pump 30A through an assist solenoid valve 33A. The discharge pipe line of an assist hydraulic pump 32B is connected to the discharge pipe line of the hydraulic pump 30B through an assist solenoid valve 33B.

The discharge pipe line of a pilot pump 34 is connected to a pilot control valve 36 for an operation lever 35. The pilot control valve 36 is connected to a left tilt control valve 38 through a pitch back control valve 37 and to a right tilt control valve 40 through a pitch forward control valve 39. The pilot control valve 36 is connected to the second direction control valve 31B through a pitch/tilt switching solenoid valve 41. The pilot control valve 36 is also connected to the first direction control valve 31A through the pitch back control valve 37, left tilt control valve 38, pitch-forward control valve 39 and right tilt control valve 40.

The above operation lever 35 is provided with a pitch back change-over switch 35A and a pitch forward change-over switch 35B, these switches 35A, 35B being connected to the controller 18.

The output signal of the controller 18 is input to the assist solenoid valves 33A, 33B, pitch back control valve 37, pitch forward control valve 39, left tilt control valve 38, right tilt control valve 40 and pitch/tilt switching solenoid valve 41 to control these valves.

Figure 5:
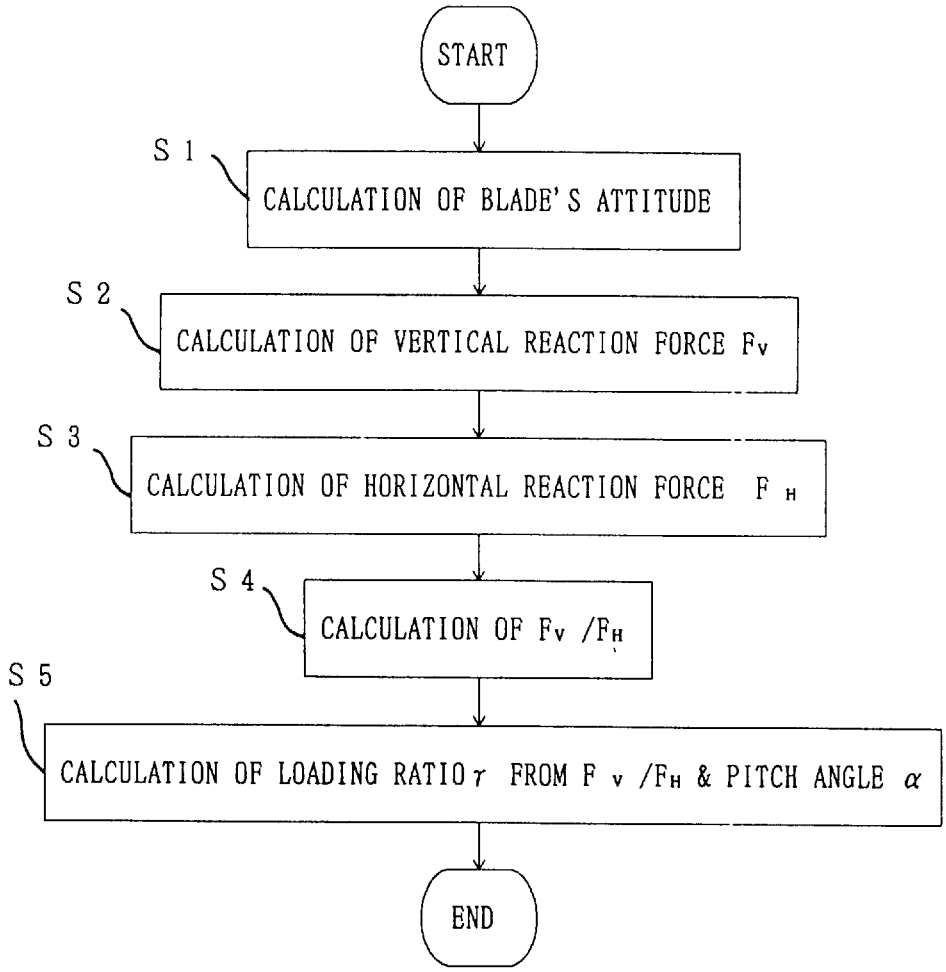
FIG. 5 is a flow chart of a program for calculating a loading ratio.

In the bulldozer 1 of the structure described above, the ratio $\gamma$ of the amount of soil loaded on the front face of the blade 7 to the loading capacity of the front face is calculated through the following steps (see FIG. 5).

Figure 6:
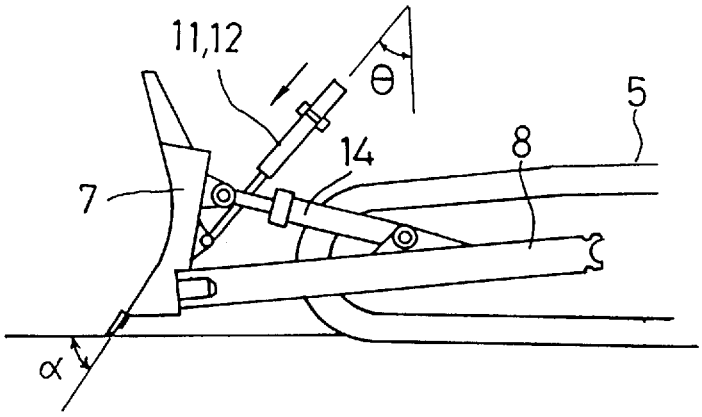
FIG.6 is a view that illustrates a yoke angle and a pitch angle.

S1: The present attitude of the blade 7 is obtained by calculation. The blade 7 has freedom of three kinds of movement, i.e., lifting (raised or lowered), tilting (lateral inclination) and pitching (forward and backward inclination) so that the attitude of the blade 7 can be determined by determining the three parameters. Namely, the attitude of the blade 7 can be determined according to the average $\theta$ of yoke angles detected by the right and left yoke angle sensors 16*a*, 16*b* and to a pitch angle $\alpha$ (see FIG. 6) detected by the stroke sensors 19*a*, 19*b*. It should be noted that normal digging depth may be used in place of the outputs of the stroke sensors 19*a*, 19*b*.

S2: The vertical reaction force $F_V$ (=the pressing force of the blade lift cylinders 11, 12) exerted on the blade 7 is calculated in the following way.

Where the average value of hydraulic pressures exerted on the respective heads of the blade lift cylinders 11, 12 and detected by the hydraulic pressure sensor 17H is $P_H$; the sectional area of each head is $A_H$; the average value of hydraulic pressures exerted on the respective bottoms of the blade lift cylinders 11, 12 and detected by the hydraulic pressure sensor 17B is $P_B$; and the sectional area of each bottom is $A_B$, the total of axial force (cylinder pressing force) $F_C$ exerted on the two cylinder rods of these blade lift cylinders 11, 12 is described by:

$$F_c=(P_B A_B-P_H A_H)\times 2$$

Accordingly, the vertical reaction force $F_V$ is obtained by:

$$F_V=F_c\cos\theta$$

where the average value of right and left yoke angles detected by the yoke angle sensors 16*a*, 16*b* is $\theta$.

S3: The horizontal reaction force $F_H$ (=the actual tractive force of the crawler belts 5) exerted on the blade 7 is calculated in the following way.

When the transmission 24 is placed in the first forward speed range (F1) or in the second forward speed (F2), actual tractive force $F_R$ is calculated in the following way according to whether the torque convertor unit 23 is in its locked up state or torque converting state.

1. Locked-up state

Figure 7:
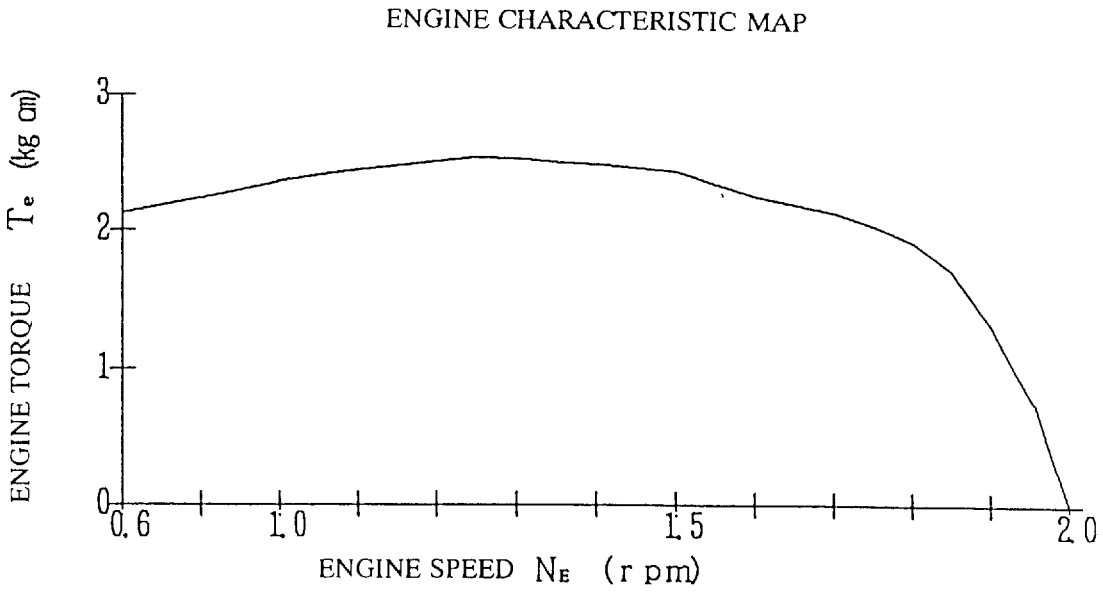
FIG.7 is a graph of an engine characteristic map.
Figure 8:
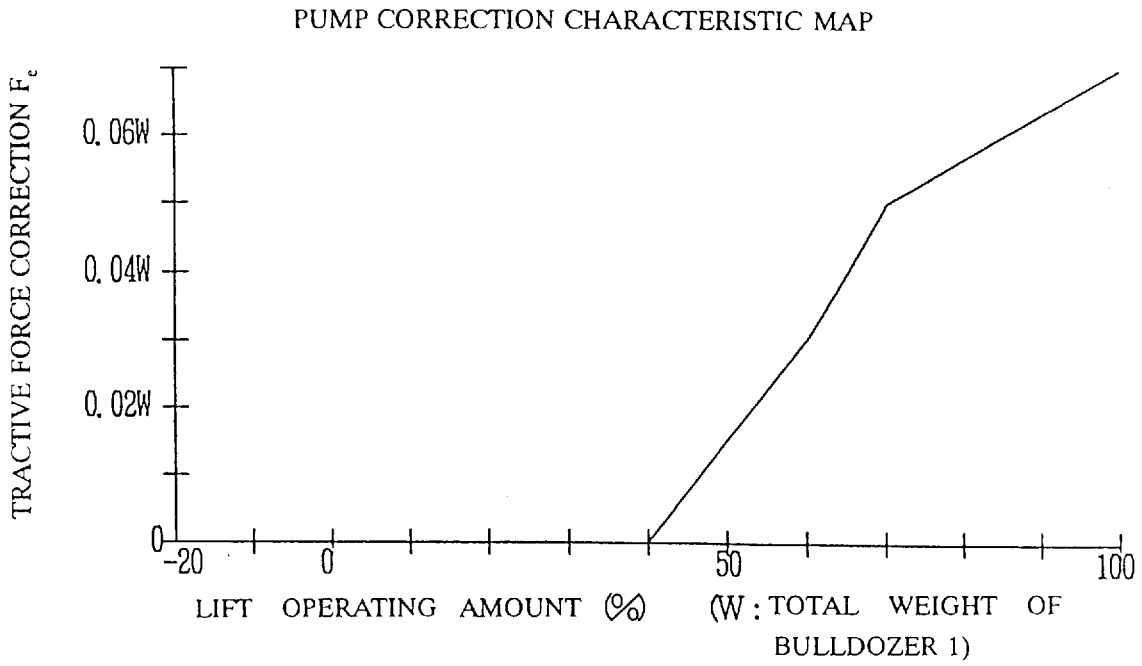
FIG.8 is a graph of a pump correction characteristic map.

Engine torque Te is obtained from the engine characteristic map shown in FIG. 7, using the engine speed $N_E$ of the engine 20. Then, the engine torque Te is multiplied by a reduction ratio $K_{se}$ between the transmission 24, the steering unit 25 and the final reduction gear mechanisms 26 (i.e., from the output shaft of the torque convertor unit 23 to the sprockets 6) and further multiplied by the radius r of the sprockets 6 thereby to obtain tractive force Fe ($=Te\times K_{se}\times r$). A tractive force correction value Fc is subtracted from the tractive force Fe to obtain actual tractive force $F_R$ ($=Fe-Fc$). The above tractive force correction value Fc corresponds to the discharge amount of the implement operating hydraulic pump etc. of the PTO 22 working on the blade lift cylinders 11, 12, this amount being obtained from the pump correction characteristic map shown in FIG. 8, using the lift operating amount of the blade 7.

2. Torque converting state

Figure 9:
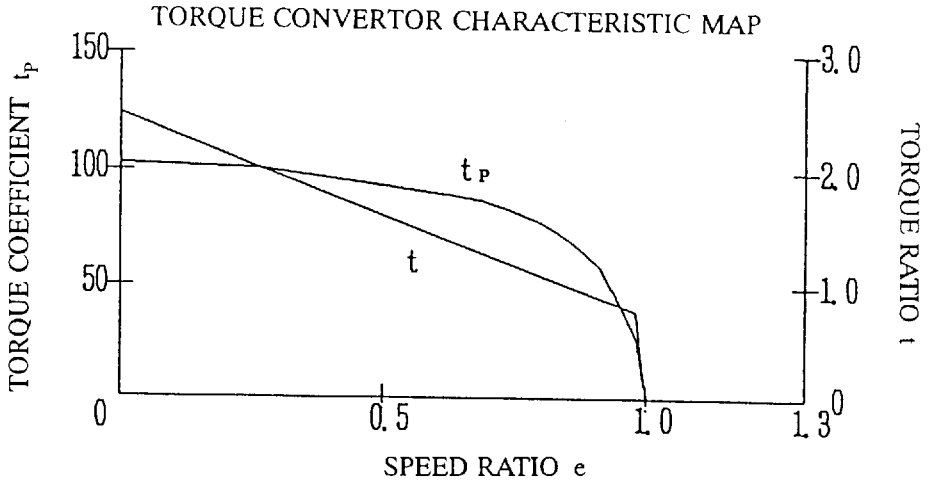
FIG.9 is a graph of a torque convertor characteristic map.

A torque coefficient $t_p$ and torque ratio t are obtained from the torque convertor characteristic map shown in FIG. 9, using a speed ratio e ($=N_t/N_E$) that is the ratio of the revolution speed $N_t$ of the output shaft of the torque convertor unit 23 to the engine speed $N_E$ of the engine 20. From the torque coefficient $t_p$ and torque ratio t, torque Tc output from the torque convertor ($=t_p\times(N_E/100)^2\times t$) is obtained. Then, the torque convertor output torque Tc is multiplied by the reduction ratio $K_{se}$ between the output shaft of the torque convertor unit 23 and the sprockets 6 and by the radius r of the sprockets 6, similarly to the case of "locked-up state", thereby obtaining actual tractive force $F_R$ ($=Tc\times K_{se}\times r$).

Figure 10:
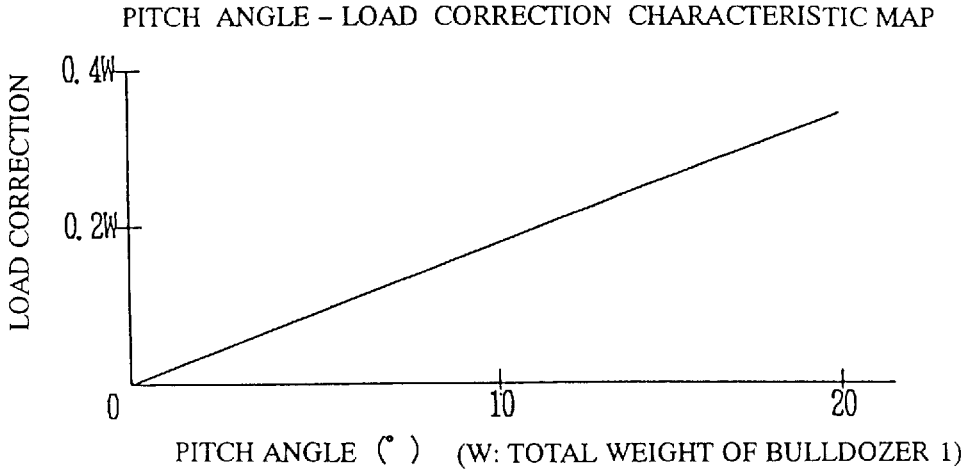
FIG.10 is a graph of a pitch angle-load correction characteristic map.

A load correction value is subtracted from the actual tractive force $F_R$ thus obtained to obtain corrected actual tractive force, that is, horizontal reaction force $F_H$. The above load correction value corresponds to the pitch angle of the vehicle body 2 and is obtained from the pitch angle to load correction characteristic map shown in FIG. 10.

Figure 11:
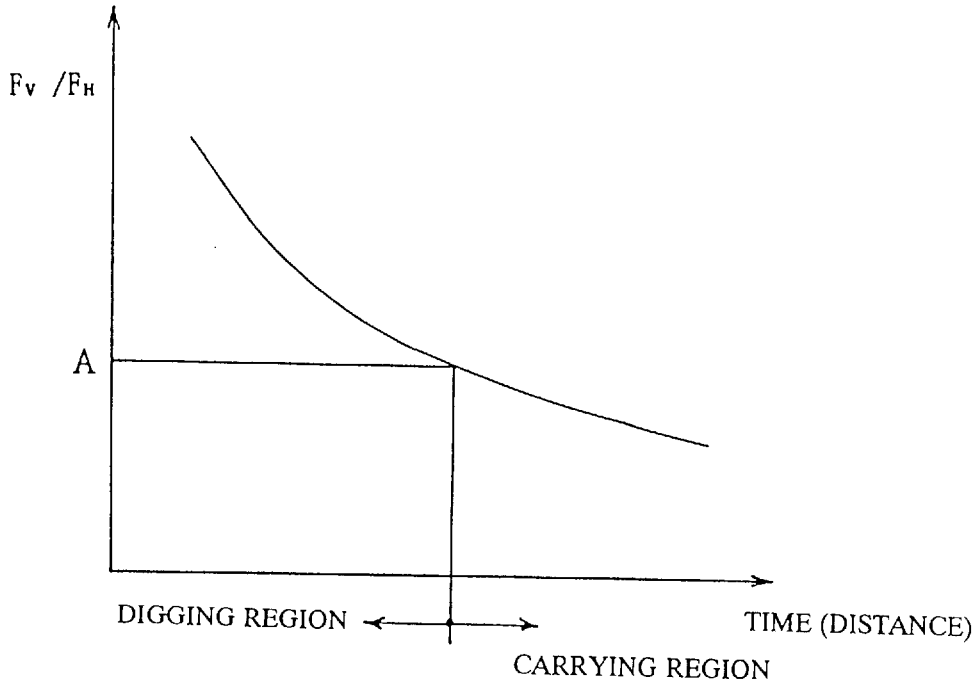
FIG. 11 is a graph showing changes in the ratio of vertical reaction force to horizontal reaction force.

S4: Now that the vertical reaction force $F_V$ and the horizontal reaction force $F_H$ are obtained, the controller 18 calculates the ratio $F_V/F_H$. As the value of the ratio $F_V/F_H$ is large during digging operation and small during carrying operation (see FIG. 11), it can be an indication for a shift from digging to carrying.

Figure 12:
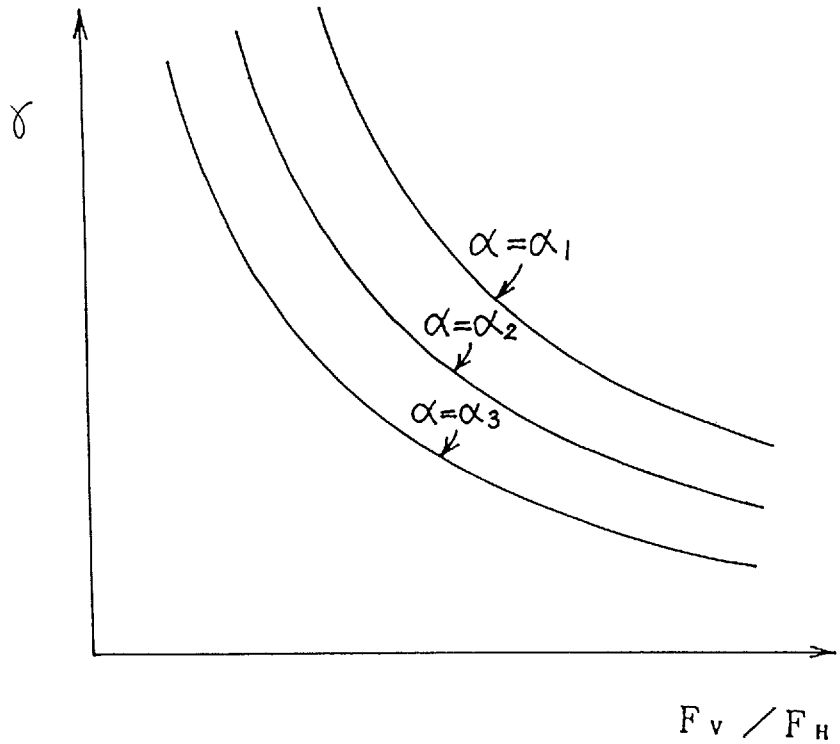
FIG.12 is a graph showing the relationship between a loading ratio $\gamma$ and the ratio of $F_V$ to $F_H$.

S5: As seen from FIG. 12, the ratio $F_V/F_H$ is correlated with the loading ratio $\gamma$ with a pitch angle $\alpha$ serving as a parameter and hence, the loading ratio $\gamma$ is obtained from the ratio $F_V/F_H$ and a pitch angle $\alpha$.

A feature of this embodiment resides in that the loading ratio $\gamma$ obtained in each dozing operation is not simply used but the distance between a digging start point and a point at which the blade 7 becomes full of loaded soil is learned from data pieces that are obtained from n previous dozing operations and representative of the relationship between the actual traveling distance and the loading ratio, in order to achieve a more accurate loading ratio $\gamma$. Next, reference is made to the flow chart of FIG. 13 to explain a procedure for calculating a loading ratio $\gamma$ and operation for controlling the blade 7 according to the calculated loading ratio $\gamma$.

Figure 14:
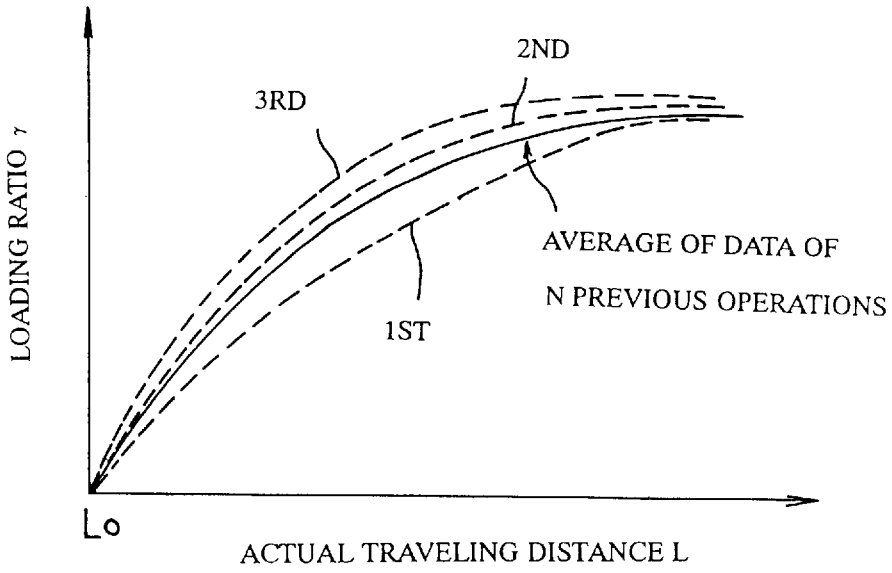
FIG.14 is a graph that illustrates the calculation of the average of sequential data representative of actual traveling distances and loading ratios.

T1: The loading ratio $\gamma$ obtained from the flow shown in FIG. 5 is stored in connection with the corresponding actual traveling distance (digging distance) L the bulldozer 1 has traveled from a point $L_0$ at which the cutting edge of the blade 7 reached the ground line when the bulldozer 1 started digging operation. In each dozing operation, the relationship (L-γ curve) between the actual traveling distance L and the loading ratio γ as shown in FIG. 14 is stored. Note that the actual traveling distance L is obtained by integrating actual vehicle speed data from a Doppler sensor (not shown) mounted on the vehicle body 2.

T2: The L-γ curves obtained from n previous dozing operations are averaged thereby to obtain an averaged curve (see FIG. 14). The number of dozing operations is limited to n times in order to accommodate variations in terrain profile and soil properties.

Figure 15:
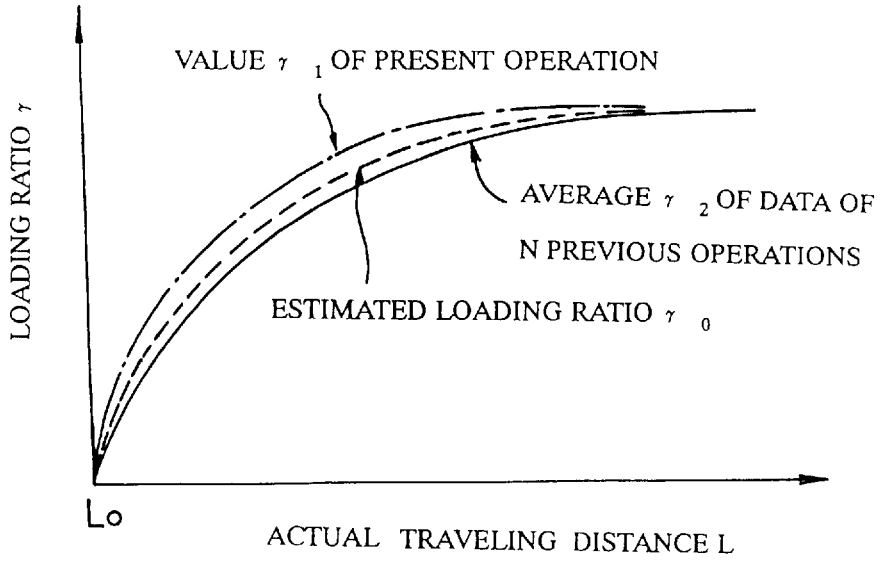
FIG. 15 is a graph that illustrates the calculation of an estimated loading ratio.

T3: A loading ratio (estimated loading ratio) $\gamma_0$ to be used for actual control is calculated from the weighted mean of a loading ratio $\gamma_1$ obtained from the present dozing operation and an average loading ratio $\gamma_2$ that is the average of the loading ratios γ of the n previous dozing operations obtained in Step T2. Concretely, the estimated loading ratio $\gamma_0$ is calculated by the following equation (See FIG. 15). Note that W represents a weighting factor.

$$\gamma_0=(\gamma_1+W\times\gamma_2)/(W+1)$$

T4: Automatic control of the blade 7 is performed with the corrected loading ratio, that is, the estimated loading ratio $\gamma_0$. More specifically, the controller 18 releases a blade pitch back instruction to allow the blade 7 to hold excavated soil, so that a shift from digging to carrying is done.

Figure 16:
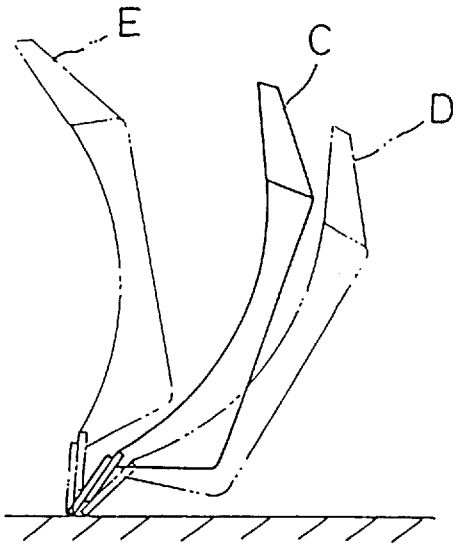
FIG. 16 is a view that illustrates the attitude of the blade.

After a blade pitch back instruction has issued from the controller 18, the pitch back control valve 37 is shifted to its position A and the pitch/tilt switching solenoid valve 41 is shifted to its position A in the hydraulic circuit shown in FIG. 3. In the mean time, an instruction signal is sent from the controller 18 to the assist solenoid valves 33A, 33B so that these valves 33A, 33B are shifted to their positions A. Therefore, the flow of pressure oil discharged from the assist hydraulic pumps 32A, 32B joins the flow in the discharge pipe line of the hydraulic pumps 30A, 30B. At that time, the pilot pressure of the pilot pump 34 is exerted on the operating section of the first direction control valve 31A through the pitch back control valve 37 and the left tilt control valve 38 and exerted on the operating section of the second direction control valve 31B through the pitch back control valve 37, the left tilt control valve 38 and the pitch/tilt switching solenoid valve 41. This allows the first direction control valve 31A and the second direction control valve 31B to be shifted to their positions B so that the pressure oil discharged from the hydraulic pump 30A is flowing into the head chamber of the blade pitch cylinder 14 through the first direction control valve 31A while the pressure oil discharged from the hydraulic pump 30B is flowing into the head chamber of the blade pitch cylinder 15 through the second direction control valve 31B. In this way, the blade pitch cylinders 14, 15 are simultaneously shortened and the blade 7 promptly pitches back (backward inclination) so that the attitude of the blade 7 is changed from the digging attitude C to the carrying attitude (pitch back attitude) D as shown in FIG. 16. It should be noted that alphabetical code E in FIG. 16 designates the pitch forward attitude of the blade 7 during unloading operation.

According to this embodiment, data pieces each representing the actual traveling distance (digging distance) L of the bulldozer 1 and the associated loading ratio γ and obtained from n previous dozing operations are averaged, and based on this averaged data, a loading ratio obtained in the present dozing operation is corrected. With this arrangement, even if an error occurs in the detection of a loading ratio due to poor detection accuracy in the present dozing operation, an accurate estimated loading ratio can be established, which contributes to improved efficiency and man power saving in dozing operation. In addition, the blade 7 is controlled with the accurate estimated loading ratio, a shift from the digging mode to the carrying mode can be stably carried out.

Figure 13:
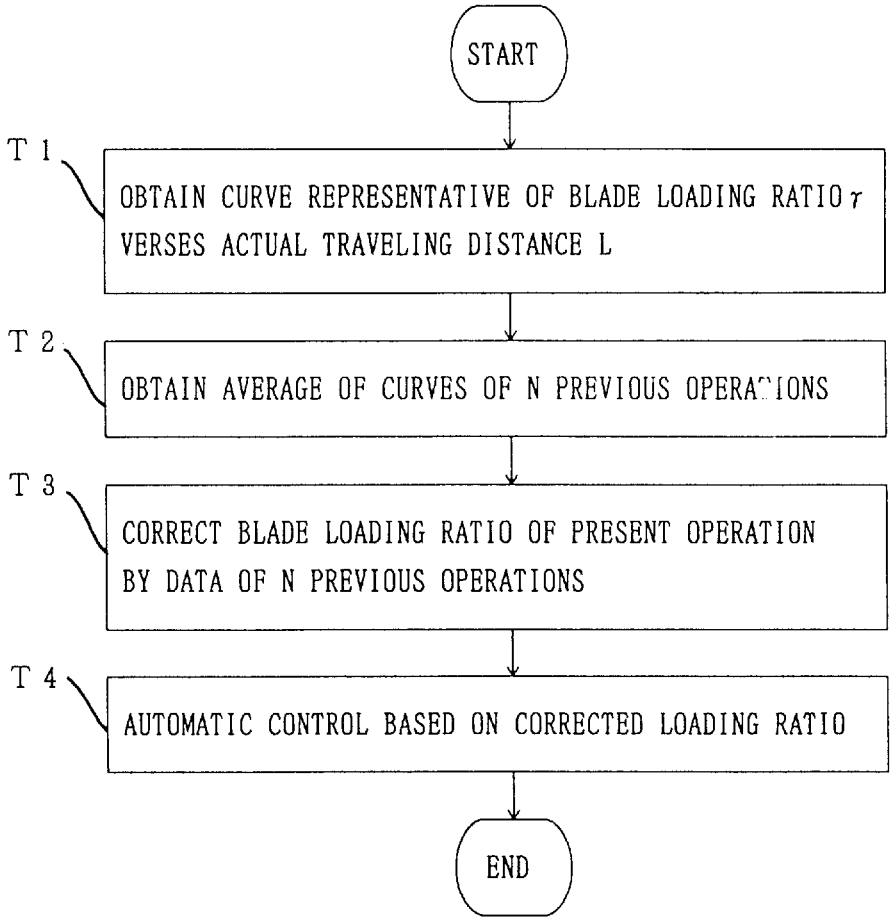
FIG.13 is a flow chart of a program for calculating an estimated loading ratio and controlling the blade.

In this embodiment, the average of the data pieces (L-γ curves) of n operations is obtained from simple averaging in the step T2 of the flow shown in FIG. 13. This average may be obtained by weighting the latest data pieces taken out of the data pieces of n operations and calculating the moving average of the weighted latest data pieces. In this case, the average $\gamma_i$ is obtained by the following equation.

$$\gamma_i=(\gamma_1+(n-1)\gamma_{i-1})/n$$

where $\gamma_1$ denotes the latest data piece of L-γ curve (i.e., the loading ratio obtained in the latest dozing operation).

This embodiment is preferably arranged such that an allowable range $\gamma_2\pm\Delta\gamma$ is established for the loading ratio $\gamma_2$ that is the average of the L-γ curve data pieces of n previous operations, and that when calculating an estimated loading ratio $\gamma_0$ (at step T3 in the flow of FIG. 13), if the loading ratio γ obtained in the present dozing operation exceeds the allowable range $\gamma_2\pm\Delta\gamma$, the loading ratio γ is judged to be an abnormal value and this abnormal value is discarded as unacceptable data. In this case, the average loading ratio $\gamma_2$ obtained from the n previous operations is used in the control of the blade 7 in the later operation.

While horizontal reaction force $F_H$ is obtained through calculation in this embodiment, it may be obtained from the amount of driving torque of the sprockets 6 detected by a driving torque sensor. Alternatively, horizontal reaction force $F_H$ is obtained from the amount of bending stress exerted on the trunnions 10 by the straight frames 8 for supporting the blade 7, this amount being detected by a bending stress sensor.

While the torque convertor unit 23 with a lock-up mechanism is incorporated in the power transmission system of this embodiment, the invention may, of course, be applied to cases where a torque convertor having no lock-up mechanism or a direct transmission having no torque convertor is used. In the case of a direct transmission, horizontal reaction force $F_H$ is calculated in the same way as described in the case of "the locked-up state" described previously.

In the detection of vertical reaction force $F_V$ in this embodiment, the pressing force of the blade lift cylinders 11, 12 is obtained by detecting hydraulic pressures at the heads and bottoms of the blade lift cylinders 11 12. The pressing force may be obtained from the axial forces of the blade lift cylinders 11, 12 detected by strain gauges respectively attached to the cylinder rods of the blade lift cylinders 11, 12.

In this embodiment, vertical reaction force $F_V$ is obtained by multiplying the above pressing force by the cosine (cos θ) of the inclination angle of the yokes relative to a vertical axis, the inclination angle being detected by the yoke angle sensors. This inclination angle θ is a substantially fixed value in dozing operation and therefore vertical reaction force $F_V$ may be calculated with the inclination angle θ set as a constant.

In this embodiment, the loading ratio of the blade 7 is calculated from the ratio of the vertical reaction force exerted on the blade 7 to the horizontal reaction force exerted on the blade 7. This loading ratio may be obtained by measuring the height of soil loaded on the front face of the blade 7 with a pair of distance sensors (ultrasonic sensors or laser sensors) attached to the front part (e.g., the upper portions of the blade lift cylinders 11, 12) of the vehicle body 2.

We claim:

1. A dozing system for use in a bulldozer, the system comprising:

(a) loading ratio calculating means for calculating the loading ratio of the front face of a blade corresponding to the digging distance of the bulldozer during dozing operation, the loading ratio being the ratio of the amount of loaded soil to the loading capacity of the blade, (b) average calculating means for storing digging distance-loading ratio data pieces obtained from a specified number of previous dozing operations, each data piece representing digging distances and their associated loading ratios calculated by the loading ratio calculating means, and for calculating the average of the stored data pieces obtained from the specified number of previous dozing operations; and (c) correcting means for correcting a loading ratio obtained in the present dozing operation, based on the average of the previous data pieces calculated by the average calculating means.

2. A dozing system for use in a bulldozer according to claim 1, further comprising blade controller means for changing the attitude of the blade from a digging attitude to a carrying attitude by pitching the blade back when the loading ratio corrected by the correcting means is equal to a predetermined value.

3. A dozing system for use in a bulldozer according to claim 1 or 2, wherein said average calculating means calculates the average by simply averaging the digging distance-loading ratio data pieces obtained from the specified number of previous dozing operations.

4. A dozing system for use in a bulldozer according to claim 1 or 2, wherein said average calculating means calculates the average by weighting the latest data pieces taken out of the previous digging distance-loading ratio data pieces and obtaining the moving average of the weighted data pieces.

5. A dozing system for use in a bulldozer according to claim 1 or 2, wherein said correcting means corrects a loading ratio obtained in the present dozing operation based on the weighted mean of the data obtained from the present dozing operation and the average of the data pieces obtained from the specified number of previous dozing operations.

6. A dozing system for use in a bulldozer according to claim 5, wherein a specified allowable range is set for the average of the digging distance-loading ratio data pieces obtained from the specified number of previous dozing operations and when a loading ratio obtained in the present dozing operation does not fall in the specified allowable range, this loading ratio is determined to be abnormal and discarded as unacceptable data.

* * * * *